US011143068B2

(12) United States Patent
Yuan et al.

(10) Patent No.: US 11,143,068 B2
(45) Date of Patent: Oct. 12, 2021

(54) OIL AND GAS SEPARATION DEVICE FOR INTERNAL COMBUSTION ENGINE

(71) Applicant: CHONGQING ZONGSHEN GENERAL POWER MACHINE CO., LTD., Chongqing (CN)

(72) Inventors: Bin Yuan, Chongqing (CN); Xi Wang, Chongqing (CN)

(73) Assignee: CHONGQING ZONGSHEN GENERAL POWER MACHINE CO., LTD., Chongqing (CN)

( * ) Notice: Subject to any disclaimer, the term of this patent is extended or adjusted under 35 U.S.C. 154(b) by 48 days.

(21) Appl. No.: 16/604,162

(22) PCT Filed: Sep. 5, 2018

(86) PCT No.: PCT/CN2018/104123

§ 371 (c)(1),
(2) Date: Oct. 10, 2019

(87) PCT Pub. No.: WO2019/056945

PCT Pub. Date: Mar. 28, 2019

(65) Prior Publication Data

US 2020/0149447 A1 May 14, 2020

(30) Foreign Application Priority Data

Sep. 25, 2017 (CN) ..... 201710874484.6

(51) Int. Cl.
*F01M 13/00* (2006.01)
*F01M 13/02* (2006.01)
*F01M 13/04* (2006.01)

(52) U.S. Cl.
CPC ..... *F01M 13/0011* (2013.01); *F01M 13/022* (2013.01); *F01M 13/04* (2013.01); *F01M 2013/0461* (2013.01)

(58) Field of Classification Search
CPC ..... F01M 2013/0461; F01M 13/022; F01M 13/04; F01M 13/0011
See application file for complete search history.

(56) References Cited

U.S. PATENT DOCUMENTS 7,678,169 B1 3/2010 Gwin et al.
9,151,195 B2 * 10/2015 Statter ..... F01M 13/0405

FOREIGN PATENT DOCUMENTS

CN 200978696 Y 11/2007
CN 203962100 U 11/2014
(Continued)

*Primary Examiner* — Kevin A Lathers
(74) *Attorney, Agent, or Firm* — Bayramoglu Law Offices LLC

(57) ABSTRACT

An oil and gas separation device for an internal combustion engine includes a first chamber, a second chamber, and a third chamber provided successively from bottom to top, wherein the first chamber is connected to the second chamber through a first gas channel. The second chamber is connected to the third chamber through a second gas channel. The third chamber is connected to a gas outlet pipe. A bottom of the first chamber is connected to an internal combustion engine body. A lower oil baffle plate is provided between the bottom of the first chamber and the internal combustion engine body. The first gas channel is longitudinally covered by the lower oil baffle plate. The oil and gas separation effect and speed can be improved by employing the oil and gas separation device for the internal combustion engine of the present disclosure.

20 Claims, 6 Drawing Sheets

(56) References Cited

FOREIGN PATENT DOCUMENTS

| | | | | | |
|---|---|---|---|---|---|
| CN | 104564234 | A | | 4/2015 | |
| CN | 206190416 | U | | 5/2017 | |
| CN | 107687355 | A | | 2/2018 | |
| CN | 207598316 | U | | 7/2018 | |
| DE | 102010043060 | A1 | | 5/2012 | |
| EP | 1447532 | A2 | | 8/2004 | |
| GB | 2004474 | A | * | 9/1978 | ..... B01D 45/08 |
| GB | 2004474 | A | | 4/1979 | |
| JP | 2009121281 | A | | 6/2009 | |

* cited by examiner

OIL AND GAS SEPARATION DEVICE FOR INTERNAL COMBUSTION ENGINE

CROSS REFERENCE TO THE RELATED APPLICATIONS

This application is the national phase entry of International Application No. PCT/CN2018/104123, filed on Sep. 5, 2018, which is based upon and claims priority to Chinese Patent Application No. 201710874484.6, filed on Sep. 25, 2017, the entire contents of which are incorporated herein by reference.

TECHNICAL FIELD

The present disclosure relates to an oil and gas separation device, and particularly to the oil and gas separation device for an internal combustion engine.

BACKGROUND

During the operation of internal combustion engines, the engine oil is delivered to the moving parts of the internal combustion engine to lubricate and cool the moving parts, thereby ensuring the normal operation of the internal parts of the internal combustion engine. During the operation of the internal combustion engine, the engine oil will gradually evaporate to form an oil and gas mixture due to pressure changes, high temperature, heat dissipation and other reasons. The oil and gas mixture generated by pressure and temperature changes is directly interconnected to the exterior through the breather valve of the internal combustion engine. With increase in the working time, the consumption of the oil of the internal combustion engine increases, seriously affecting the performance and service life of the whole machine. In order to improve the performance of the product, an oil and gas separation structure is added to a gas outlet, so that the separated liquid engine oil returns into the internal combustion engine to lubricate the moving parts, and the separated gas enters an air filter to realize the recycling of the oil and gas, thereby diminishing the engine oil loss.

A Chinese patent having the application number as No. CN206190416U discloses a cylinder head cover, and specifically discloses a cylinder head cover body. An inner chamber of the cylinder head cover body is horizontally provided with a breather valve partition configured to divide the inner chamber of the cylinder head cover into an upper chamber and a lower chamber. A breather valve is provided on each breather valve partition configured to connect the upper chamber and the lower chamber. A gas outlet connected to the upper chamber is provided on the body of the cylinder head cover. The upper chamber is internally provided with a labyrinth structure. A lower oil baffle plate connected to the breather valve partition is horizontally provided in the lower chamber and under the breather valve partition. There is a gap between an outer edge of the lower oil baffle plate and an inner wall of the cylinder head cover, and an oil return hole is provided on the breather valve partition and located at a lowermost position of the breather valve partition.

The consumption of the engine oil can be temporarily reduced by employing the cylinder head cover of the above-mentioned patent. However, the experiments indicate that the oil flows out through the gas outlet in 2-5 hours. Therefore, the oil and the gas fail to be separated completely, resulting in the wastage of the lubricating oil.

Moreover, the cylinder head cover is limited by the working condition of the internal combustion engine. The worse the working condition is, the worse is the effect of the oil and gas separation.

SUMMARY

The objective of the present disclosure is to provide an oil and gas separation device capable of effectively, quickly and sustainably separating the oil and gas even under a poor working condition.

To this end, the present disclosure is realized by the following technical solution. An oil and gas separation device for an internal combustion engine includes a first chamber, a second chamber, and a third chamber arranged successively from bottom to top. The first chamber is connected to the second chamber through a first gas channel. The second chamber is connected to the third chamber through a second gas channel. The third chamber is connected to a gas outlet pipe. A bottom of the first chamber is connected to an internal combustion engine body, and a lower oil baffle plate is provided between the bottom of the first chamber and the internal combustion engine body. The first gas channel is longitudinally covered by the lower oil baffle plate. The oil and gas separation device is designed in the above-mentioned manner to effectively and sustainably separate the oil and the gas, so that the engine oil in the oil and gas mixture generated in the internal combustion engine can quickly return into the internal combustion engine body, and the separated gas enters an air filter through a gas outlet pipe to avoid environmental pollution. The oil and gas separation device has a good separation effect, and can effectively and quickly separate the oil and the gas even under severe working conditions such as high temperature, high pressure, and vibrations.

In order to further improve the oil and gas separation effect, the lower oil baffle plate is an annulus arranged along the bottom of the first chamber. The outer edge of the annular lower baffle is connected to a housing of the oil and gas separation device. An inner edge of the lower oil baffle forms a gas inlet of the first chamber.

In order to further increase the oil and gas separation speed, the lower oil baffle includes an outer annulus and an inner annulus from outside to inside. The outer annulus is flat plate-like and covers the first gas channel. The inner annulus has a shape of an inverted cone and faces toward the internal combustion engine body. The lower oil baffle is arranged in the above-mentioned manner to enlarge the adhesion area of the oil and gas mixture, improve the effect of oil and gas separation, and further make the separated engine oil quickly return into the internal combustion engine body to proceed with lubrication.

To further optimize the structure of the present disclosure, the first chamber, the second chamber, and the third chamber are longitudinally arranged along the housing. The first chamber is composed of an inner wall of a cover and the lower oil baffle plate. The second chamber is composed of an outer wall of the cover, an upper oil baffle plate provided on the cover, and an inner wall of the housing. The third chamber is composed of the upper oil baffle plate and the inner wall of the housing. The first chamber, the second chamber, and the third chamber are arranged in the above-mentioned manner to have a simple structure, a good usage effect, and a low cost.

Preferably, a gap between an edge of the cover, the housing, and the lower oil baffle plate forms the first gas channel. A breather valve hole of a breather valve device provided on the upper oil baffle plate is the second gas channel. The first gas channel and the second gas channel are arranged in the above-mentioned manner to form a step-shaped gas path, which greatly enlarges the gas path. The gas adhesion area is large, so as to further improve the separation effect of the oil and gas mixture.

In order to further increase the oil and gas separation speed, the cover is provided with an inclined side wall. The side wall is inclined outward from a top surface of the cover to the internal combustion engine body. By employing the above arrangement, most of the engine oil in the oil and gas mixture adhere onto the inclined side wall of the cover. The engine oil is accumulated to form oil drops, flowing along the inclined side wall. Then, the oil drops flow back into the first chamber through the first gas channel, and further flow back into the internal combustion engine body.

In order to further improve the oil and gas separation effect, the breather valve hole of the breather valve device faces toward the top surface of the cover, and the top surface of the cover is provided with an inclined oil guiding groove facing toward the breather valve hole. The breather valve hole and the inclined oil guiding groove is arranged in the above-mentioned manner to prevent the oil droplets from moving upwards in the moving direction of the internal combustion engine through the second gas channel into the third chamber. Meanwhile, the accumulated oil droplets flow along the inclined oil guiding groove, flow back into the first chamber, and further return into the internal combustion engine body.

In order to further improve the oil and gas separation effect, a labyrinth structure is provided inside the third chamber. The labyrinth structure is composed of at least one limiting block transversely arranged between the breather valve hole and the gas outlet pipe. The labyrinth structure is designed to enlarge the gas path and the gas adhesion area.

In order to further improve the oil and gas separation effect, the labyrinth structure includes a first transverse baffle plate provided close to the breather valve hole and a second transverse baffle plate provided close to the gas outlet pipe. An end of the first transverse baffle plate and an end of the second transverse baffle plate are connected to a wall of the housing. The other ends thereof are away from the wall of the housing to form openings. The opening of the first transverse baffle plate and the opening of the second transverse baffle plate face are arranged in opposite directions. One or two sides of the first transverse baffle plate are provided with an oil return hole connected to the second chamber. The oil droplets adhering to the third chamber flow into the second chamber through the oil return hole and further flow back into the first chamber along the inclined side wall of the second chamber. In the end, the oil droplets flow back into the internal combustion engine body.

In order to further improve the oil and gas separation effect, the second transverse baffle plate facing toward a gas inlet of the gas outlet pipe is provided close to the gas outlet pipe. A longitudinal baffle plate is provided between the opening formed by the second transverse baffle plate and the wall of the housing and the gas inlet of the gas outlet pipe. An air spraying hole is formed between the longitudinal baffle plate and second transverse baffle plate. A gas backflow hole is provided on the second transverse baffle plate on another side of the gas inlet of the gas outlet pipe. By employing the above arrangement, the gas is continuously circulated inside the labyrinth structure and continuously attached to the labyrinth structure, which enlarges the operation path of the gas and ensures the complete separation of the oil and gas.

The present disclosure has the following advantages. The oil and gas separation device for the internal combustion engine of the present disclosure can fully separate the oil and gas mixture in the internal combustion engine body and enable the engine oil to flow back into the internal combustion engine body for further usage. The waste gas flows into the air filter through the gas outlet pipe to be processed.

Moreover, the oil and gas separation device for the internal combustion engine of the present disclosure has a good separation effect, and can ensure no oil droplets flowing out in 200-500 hours during operation, thereby avoiding the waste of the engine oil. Thus, it is assured that the engine oil in the internal combustion engine is sufficient and the lubrication of various components of the internal combustion engine is fine.

Besides, the oil and gas separation device of the present disclosure can effectively separate the oil and gas mixture even under severe working conditions such as high temperature, high pressure, and vibrations to achieve the above-mentioned separation effect.

Figure 1:
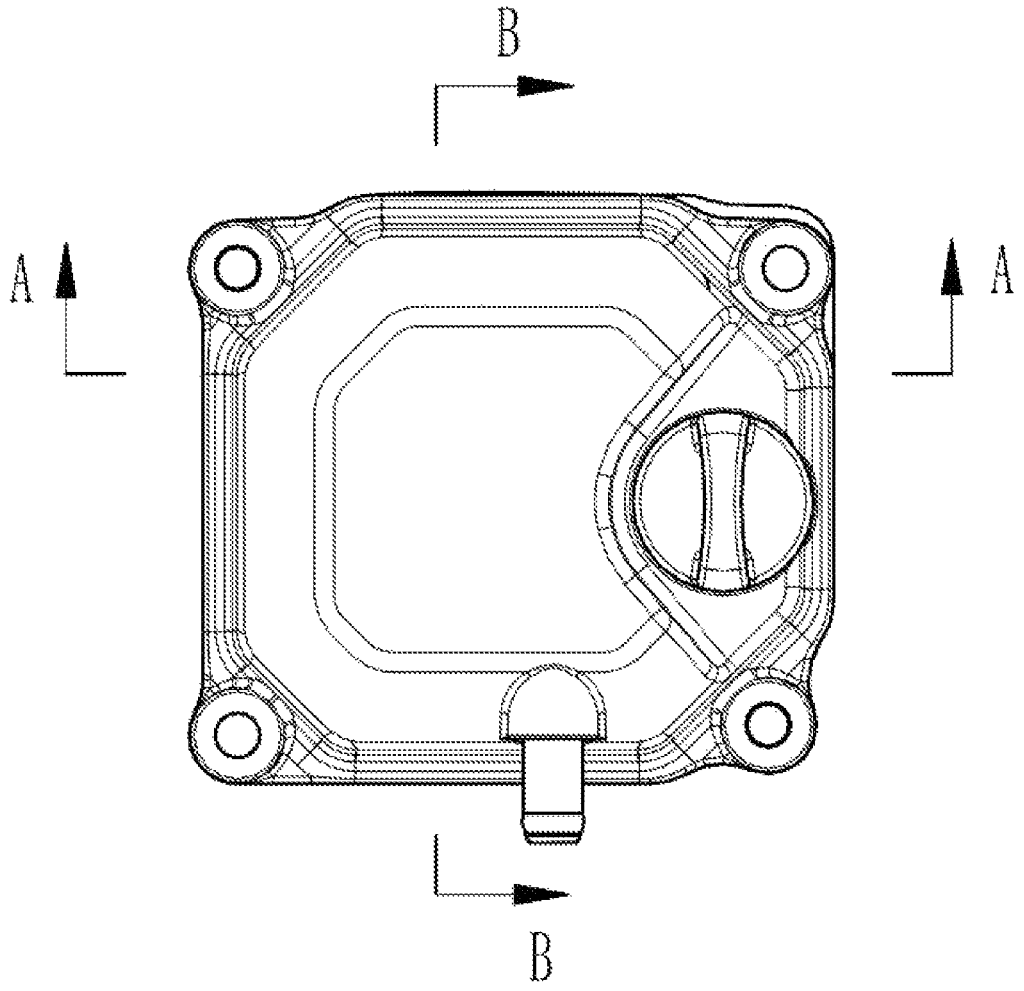
FIG. 1 shows an appearance of an internal combustion engine body.

The reference designators in the drawings are described as follows: 1. housing; 2. upper oil baffle plate; 3. cover; 4. lower oil baffle plate; 5. internal combustion engine body; 6. gas outlet pipe; 7. breather valve baffle plate; 8. breather valve sheet; 9. rivet; 3*a*. inclined oil guiding groove; 3*b*. side wall; 4*a*. inverted cone; 10. first chamber; 11. second chamber; 12. third chamber, 13. first gas channel; 14. second gas channel; 15. oil return hole; 16. first transverse baffle plate; 17. second transverse baffle plate; 18. longitudinal baffle plate; 19. gas backflow hole.

DETAILED DESCRIPTION OF THE EMBODIMENTS

The specific implementation modes of the present disclosure will be described in detail hereinafter with the reference to the figures. However, the present disclosure is not limited by these embodiments. Any equivalent improvements, or substitutions made according to the basic spirit of the present embodiment should be considered as falling within the scope of the claims of the present disclosure

Embodiment 1

Figure 3:
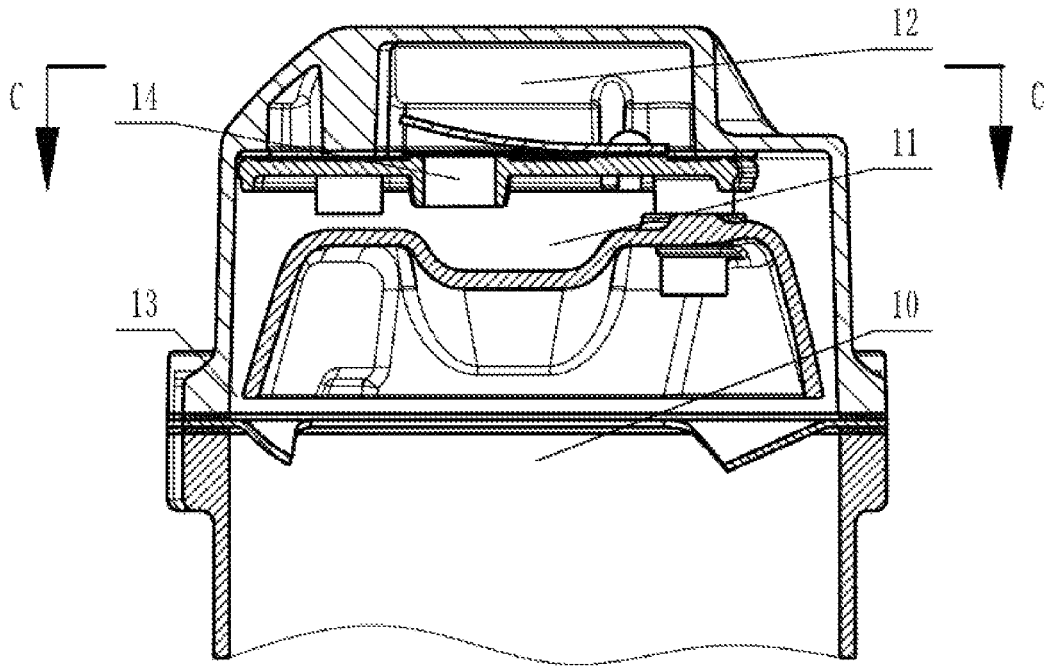
FIG. 3 is a sectional view taken on the line A-A in FIG. 1, showing the oil and gas chambers and the gas channels.

As shown in FIG. 3, an oil and gas separation device for an internal combustion engine includes the first chamber 10, the second chamber 11, and the third chamber 12 provided successively in a longitudinal direction. The first chamber 10 is connected to the second chamber 11 through the first gas channel 13. The second chamber 11 is connected to the third chamber 12 through the second gas channel 14. The third chamber 12 is connected to the gas outlet pipe 6. A bottom of the first chamber 10 is connected to the internal combustion engine body 5 and the lower oil baffle plate 4 is provided between the bottom of the first chamber 10 and the internal combustion engine body 5. The first gas channel 13 is longitudinally covered by the lower oil baffle plate 4.

Specifically, the first chamber 10, the second chamber 11, and the third chamber 12 are successively provided in the longitudinal direction, i.e., from bottom to top. In this way, the oil and gas mixture can readily flow out of the gas outlet pipe from the first chamber 10 through the second chamber 11 and the third chamber 12, which further facilitates the engine oil to flow back to the internal combustion engine body 5 under the action of gravity. The chambers may be enclosed by various kinds of components, such as a housing, a cover, a metal plate.

In the present embodiment, the lower oil baffle plate 4 is provided at the bottom of the first chamber 10, and the first gas channel 13 is overlapped by the lower oil baffle plate 4. In this way, the oil and gas mixture cannot directly flow into the second chamber 11 through the first gas channel 13 and subsequently flow out of the gas outlet pipe 6 through the third chamber 12 during the separation process, thereby avoiding the engine oil loss.

When the oil and gas mixture moves toward the oil and gas separation device, most of the oil and gas mixture moving upward is blocked by a top of the first chamber 10, so that the engine oil in the mixture directly returns to the internal combustion engine body. A part of the oil and gas mixture moving upward is blocked by the lower oil baffle plate 4, so that the engine oil thereof also directly returns to the internal combustion engine body. A little amount of the engine oil mixture moving irregularly reciprocates between a wall of the first chamber 10 and the lower oil baffle plate 4, and the part of the engine oil is distributed on the lower oil baffle plate 4 and finally slips into the internal combustion engine body 5 for lubrication. Therefore, the great majority of the engine oil in the first chamber 10 is separated and quickly returns into the internal combustion engine body 5 for lubrication, and only a small amount of engine oil moving intensely passes through the first gas channel 13 into the second chamber 11. At that time, a first-stage oil and gas separation is achieved.

The oil and gas mixture entering the second chamber 11 itself contains a small amount of engine oil. When the oil and gas mixture moves from the second chamber 11 into the third chamber 13 and moves toward the second gas channel 14, the engine oil thereof will adhere onto the chamber wall of the second chamber 11 and further flow back into the internal combustion engine body 5 under the action of the gravity through the first gas channel 13 for another lubrication. At that time, a second-stage oil and gas separation is achieved.

The oil and gas mixture entering the third chamber 12 through the second gas channel 14 itself contains a very little amount of engine oil or no engine oil. When the mixture flows out of the gas outlet pipe 6 through the second gas channel 14, the very little amount of engine oil thereof will adhere onto the chamber wall of the third chamber 12, so that the remaining engine oil is separated, and then flows into the internal combustion engine body 5 through the second gas channel 14 and the first gas channel 13 for lubrication. The separated waster gas flows into an air filter through the gas outlet pipe 6 for processing, finally achieving a third-stage oil and gas separation.

The oil and gas separation device for the internal combustion engine of the present embodiment can effectively and sustainably separate the oil and the gas, so that the oil in the oil and gas mixture generated in the internal combustion engine can quickly return to the internal combustion engine body, and the separated gas enters the air filter through the gas outlet pipe to avoid the environment pollution. The present embodiment has a good separation effect, ensuring that no engine oil flows out of the gas outlet pipe for at least 200 hours at work, and the oil and the gas can be separated effectively and quickly even under severe working conditions such as high temperature, high pressure and vibrations.

Embodiment 2

As shown in FIGS. 1-5, an oil and gas separation device for an internal combustion engine includes the first chamber 10, the second chamber 11, and the third chamber 12 provided successively in a longitudinal direction. The first chamber 10 is connected to the second chamber 11 through the first gas channel 13. The second chamber 11 is connected to the third chamber 12 through the second gas channel 14. The third chamber 12 is connected to the gas outlet pipe 6. A bottom of the first chamber 10 is connected to the internal combustion engine body 5 and the lower oil baffle plate 4 is provided between the bottom of the first chamber 10 and the internal combustion engine body 5. The first gas channel is longitudinally covered by the lower oil baffle plate 4.

Specifically, the first chamber 10, the second chamber 11, and the third chamber 12 are successively provided in a longitudinal direction, i.e., from bottom to top. In this way, the oil and gas mixture can readily flow out of the gas outlet pipe from the first chamber 10 through the second chamber 11 and the third chamber 12, which further facilitates the engine oil to return to the internal combustion engine body 5 under the action of gravity. The chamber may be enclosed by various kinds of components, such as a housing, a cover, a metal plate.

In the present embodiment, the first chamber 10, the second chamber 11, and the third chamber 12 are longitudinally arranged along the housing 1 of the separating device. The upper oil baffle plate 2 and the cover 3 with an opening facing downward are provided in the housing 1 from top to bottom, and the lower oil baffle plate 4 is provided between the housing 1 and the internal combustion engine body 5. A lower edge of the housing 1, an outer edge of the lower oil baffle plate 4, and an upper edge of the internal combustion engine body 5 are locked together (by any connection means such as welding, screwing, etc.). The first chamber 10 is composed of an inner wall of the cover 3 and the lower oil baffle plate 4. The second chamber 11 is composed of an outer wall of the cover 3, the upper oil baffle plate 2 provided on the cover 3 and a side wall of the housing 1. The third chamber 12 is composed of the upper oil baffle 2, the side wall and a top wall of the housing 1. A gap provided between an edge of the cover 3, the housing 1, and the lower oil baffle plate 4 forms the first gas channel 13. A breather valve hole of a breather valve device provided on the upper oil baffle plate 2 is the second gas channel 14.

Specifically, the lower oil baffle plate 4 is an annulus provided along a bottom of the cover 3. An inner edge of the lower oil baffle plate 4 forms a gas inlet of the first chamber 10, and the oil and gas mixture generated in the internal combustion engine body 5 enters the first chamber 10 through the gas inlet.

Further, the lower oil baffle plate 4 includes an outer annulus and an inner annulus from outside to inside. The outer annulus is flat plate-like and covers the first gas channel 13. The inner annulus is the inverted cone 4*a* facing toward the internal combustion engine body.

With the oil and gas separation device of the present embodiment, when the oil and gas mixture moves toward the oil and gas separation device, most of the oil and gas mixture moving upward is blocked by a top of the cover 3, so that the engine oil in the mixture directly returns to the internal combustion engine body 5. A part of oil and gas mixture moving upward is blocked by the lower oil baffle plate 4, and the engine oil thereof also directly returns to the internal combustion engine body 5 likewise. A small amount of engine oil mixture moving irregularly reciprocates between the inner wall of the cover 3 and the lower oil baffle plate 4. Then, the part of the engine oil is distributed on the lower oil baffle plate 4, and finally slips into the internal combustion engine body 5 through the inner annulus of the lower oil baffle plate 4 for lubrication. Therefore, the great majority of the engine oil in the first chamber 10 is separated and quickly returns to the internal combustion engine body for lubrication. Only a very little amount of engine oil moving intensely passes through the first gas channel 13 and enters the second chamber 11 along with the gas. At that time, a first-stage oil and gas separation is achieved. As shown in the motion trend diagram of the oil and gas mixture in FIG. 4, a lower thick arrow represents an upward movement direction of the oil and gas mixture. When the oil and gas mixture moves upward until being blocked by the inner top wall of the cover 3, the oil and gas mixture moves downward (shown by the arrow III in the figures). Or, when the oil and gas mixture moves upward until being blocked by the inverted cone 4*a* of the lower oil baffle plate 4, the oil and gas mixture moves downward (shown by the arrows II and V in the figures).

The cover 3 and the lower baffle 4 are configured to prevent the oil and gas mixture from directly entering the second chamber 11 through the first gas channel 13 and to enlarge a movement path and an adhesion area of the oil and gas mixture. Consequently, the engine oil and waste gas of the most gas and oil mixture are effectively separated during the first-stage oil and gas separation process, and by the arrangement of the inverted cone of the inner annulus, the engine oil can quickly return to the internal combustion engine boy 5 for lubrication.

The oil and gas mixture entering the second chamber 11 contains a very little amount of engine oil. When the oil and gas mixture enters the third chamber 12 through the second chamber 11 and moves toward the second gas channel 14, the engine oil thereof bypasses the side wall and the top wall of the cover 3, and then enters the third chamber 12 through the second gas channel 14. In this way, the movement path of the oil and gas mixture in the second chamber 11 is approximately step-shaped, which lengthens the movement path of the oil and gas mixture and enlarging the adhesion area of the oil and gas mixture, i.e., the side wall and top wall of the cover. Consequently, the small amount of engine oil in the oil and gas mixture in the second chamber 11 mostly adheres onto the side wall and top wall of the cover 3, so as to realize a second-stage oil and gas separation. The engine oil adhering onto the side wall and top wall of the cover will slip along the side wall into the first gas channel 13, then slip onto the lower oil baffle plate 4 through the first gas channel 13, and finally slips into the internal combustion engine body 5 through the inner annulus of the lower oil baffle plate 4 for lubrication.

The oil and gas mixture entering the third chamber 12 through the gas channel 14 itself contains only a very little amount of engine oil or no engine oil. When the mixture flows into the third chamber through the second gas channel 14 and flows out of the gas outlet pipe 6, the very little engine oil adheres to the chamber wall of the third chamber 12, namely, the inner wall of the housing 1 and the upper oil baffle plate 2. The remaining engine oil in the oil and gas mixture is separated out, and then the separated engine oil flows into the internal combustion engine body through the second gas channel 14 and the first gas channel 13 for lubrication. The separated waste gas flows into an air filter through a gas outlet for processing, finally achieving a three-stage oil and gas separation.

As another implementation mode of the present embodiment, the cover 3 is provided with the inclined side wall 3*b*. The inclined side wall is inclined outward from the top surface of the cover 3 to the internal combustion engine body 5, and an inner side and outer side of the side wall are inclined. An inclination direction of the side wall of the cover is opposite to the inclination direction of the inner annulus of the lower oil stop. Such arrangement has two advantages as follows.

Figure 4:
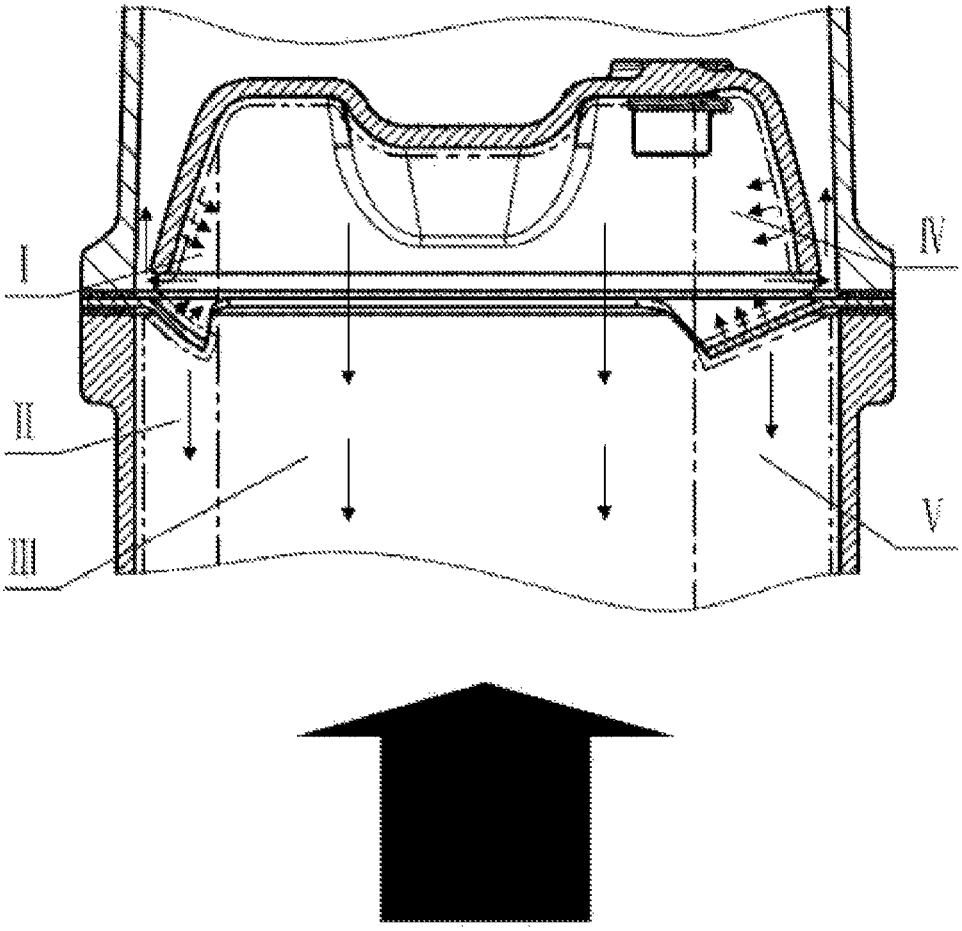
FIG. 4 is a partially enlarged view of FIG. 3, showing a motion trend of the oil and gas mixture in the first chamber.

First, in the first-stage of the oil and gas separation process, when the oil and gas mixture moving upward is blocked by the inner top wall of the cover 3, so that when the oil droplets adhere to the inner top wall, the oil droplets at an edge of the inner top wall can slip in the inclination direction of the inner side wall. The inner side wall of the cover 3 and the inner annulus of the lower oil baffle plate 4 further narrow a moving area of the oil and gas mixture, so that the oil and gas mixture in the area moves intensely, which achieves a quick separation, adhering and slipping of the engine oil and the waste gas, and reduces the engine oil entering the second chamber 11. Moreover, as shown in FIG. 4, the oil and gas mixture moves obliquely downward (see arrows I and IV in FIG. 4) when the oil and gas moving upward is blocked by the inclined inner side wall of the cover 3. A part of the oil and gas mixture is blocked directly back into the internal combustion engine body. The rest is blocked and falls onto the inverted cone of the lower baffle and then slides down into the internal combustion engine body.

Second, in the oil and gas separation process, the oil droplets condensed on the outer side wall and the outer side wall of the cover 3 can quickly slip off through the inclined outer side wall to achieve an effect of quick separation.

With the oil and gas separation device in the present embodiment, the oil and gas mixture enters the chamber 10 through the inlet of the first chamber 10, subsequently enters the second chamber 11 through the first gas channel 13 and then enters the third chamber 12 through the first gas channel 14. In this process, the first stage oil and gas separation, the second stage oil and gas separation, and the third oil and gas separation are accomplished, which can effectively separate the oil from the waste gas in the oil and gas mixture. At the same time, the separated oil can return to the internal combustion engine body 5 for lubrication, while the waste gas is discharged through the gas outlet pipe 6 provided on the third chamber 12 and enter the air filter for processing. The oil and the gas can be separated effectively and sustainably, so that the engine oil in the oil and gas mixture generated in the internal combustion engine can quickly return into the internal combustion engine body, and the separated gas enters the air filter through the gas outlet pipe to avoid environmental pollution. The present embodiment has a good separation effect, without engine oil flowing out of the gas outlet pipe for at least 400 hours at work, and the oil and the gas can be effectively and quickly separated even under severe working conditions such as high temperature, high pressure and vibration.

Embodiment 3

Figure 2:
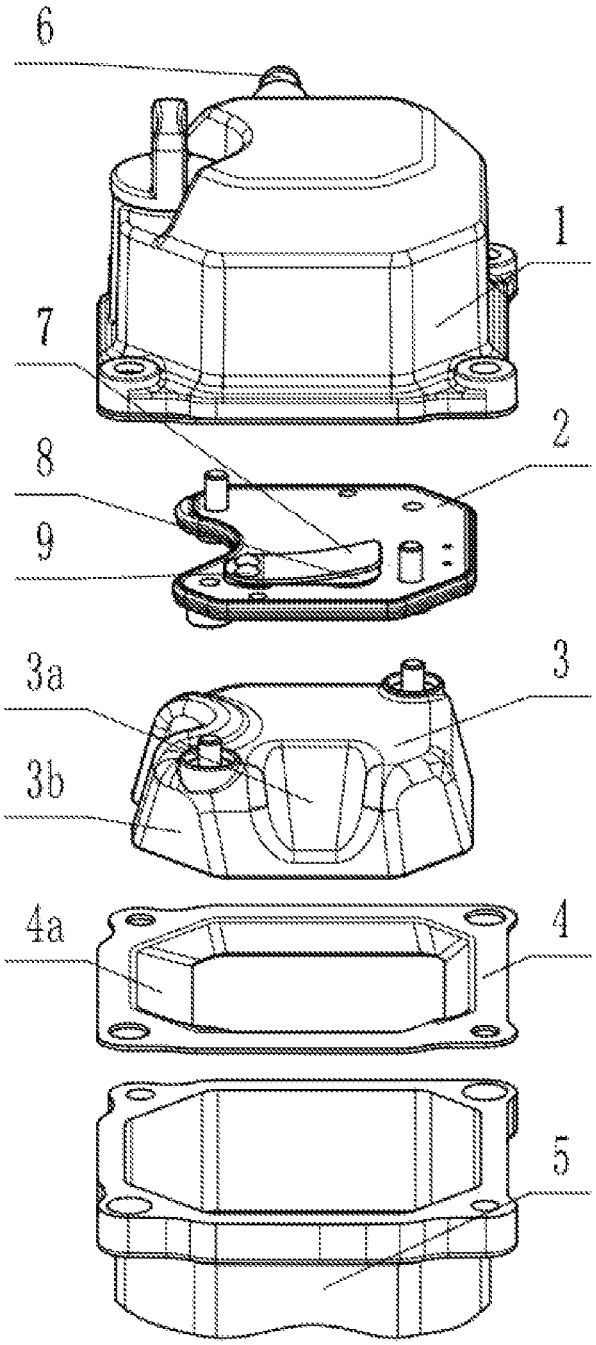
FIG. 2 is an exploded view showing the oil and gas separation device for the internal combustion engine.
Figure 5:
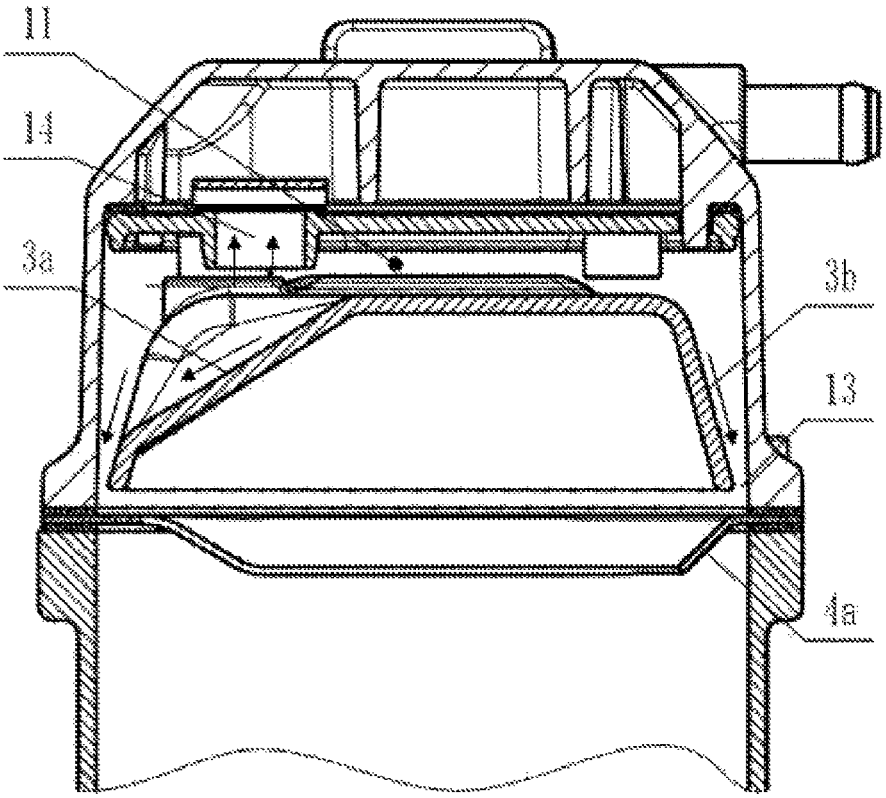
FIG. 5 is a sectional view taken on the line B-B in FIG. 1, showing the motion trend of the oil and gas mixture in the second chamber.

As shown in FIG. 2 and FIG. 5, the second gas channel 14 is formed by the breather valve device provided on the upper oil baffle plate 2. The cover 3 facing toward the breather valve hole is provided with the inclined oil guiding groove 3*a*. The rest parts of the structure are the same as the embodiment 2.

Specifically, the breather valve device includes a breather valve hole provided on the upper oil baffle plate. The breather valve sheet 8 and the breather valve baffle plate 7 are fixed on a top surface of the upper oil baffle plate 2 with the rivet 9. The breather valve sheet 8 and the breather valve baffle 7 face toward the breather valve hole. The inclined oil guiding groove 3*a* faces exactly toward the breather valve hole and is arranged to incline from a top wall of the cover 3 to a middle and lower portion of the side wall of the cover.

Owing to the above-mentioned arrangement, in the process of the second-stage oil and gas separation, when the oil and gas mixture in the second chamber 11 moves forward into the third chamber 12 through the breather valve hole, gathers into the second gas channel 14 and is blocked by the breather valve sheet, a part of the engine oil will form oil droplets gathering in the second gas channel 14 and then slip downward. When the engine oil slips into the inclined oil guiding groove 3*a*, the engine oil will slip into the first gas channel 13 along the inclined oil guiding groove 3*a* and then slip into the internal combustion engine body 5 for lubrication again.

As a result, the oil and gas separation effect and time of the oil and gas separation device are improved. The oil and gas separation device of the present embodiment can enable the separated engine oil to quickly return to the internal combustion engine body for lubrication, and has a good separation effect. No engine oil flows out of the gas outlet pipe for at least 450 hours at work, and even under severe working conditions, such as high temperature, high pressure, and vibration, the oil and the gas can be separated efficiently and quickly.

Embodiment 4

Figure 6:
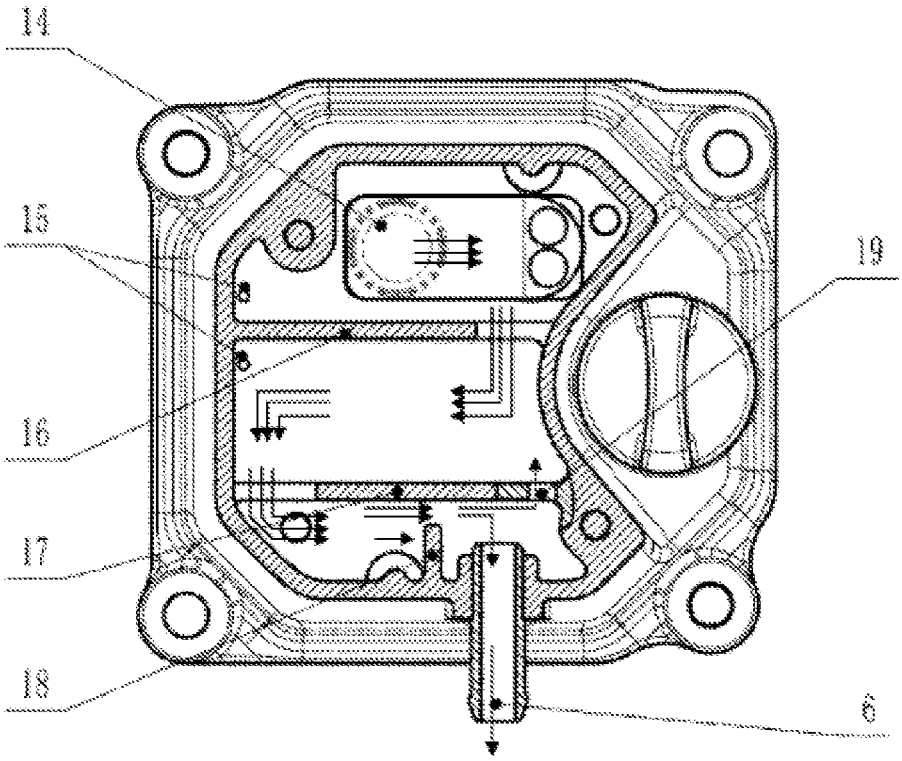
FIG. 6 is a sectional view taken on the line C-C in FIG. 3, showing the motion trend of the oil and gas mixture in the third chamber.

As shown in FIG. 6, in the present embodiment, a labyrinth structure is provided inside the third chamber 12. The labyrinth structure includes at least one limiting block transversely provided between a breather valve hole and a gas outlet pipe. The rest parts of the structure are the same as the embodiment 2 and the embodiment 3.

In the present embodiment, the labyrinth structure is an S-shaped labyrinth structure, which is formed by the first transverse baffle plate 16 provided close to the breather valve hole and the transverse baffle plate 17 provided close to the gas outlet pipe 6. An end of the first transverse baffle plate 16 and an end of the second transverse baffle plate 17 are connected to a wall of the housing, and the other ends thereof are away from the wall of the housing to form openings. The openings of the transverse baffle plate 16 and the transverse baffle plate 17 face toward opposite directions. The oil return hole 15 connected to the second chamber 11 is provided on one side or both sides of the first transverse baffle plate 16. In the present embodiment, the oil return holes 15 are provided on the upper oil baffle plate 2 on both sides of the transverse baffle plate 16.

A gas inlet end of the gas outlet pipe is provided opposite to the second transverse baffle plate 17. The longitudinal baffle plate 18 is provided between the opening formed by the transverse baffle plate 17 and the housing wall and the gas inlet of the gas outlet pipe. A gas spraying hole is formed between the longitudinal baffle plate 18 and the second transverse baffle plate 17. The gas backflow hole 19 is provided on the transverse baffle plate 17 on the other side of the gas inlet of the gas outlet pipe.

In the present embodiment, a rectangular chamber is formed by the second transverse baffle plate 17, the longitudinal baffle plate 18 and the walls of the housing. The gas outlet pipe 6 is provided on the housing beside the longitudinal baffle plate 18. The gas backflow hole 19 is provided at a root portion of a joint of the second transverse baffle plate 17 and the housing 1, namely, the gas spraying hole and the gas backflow hole 19 are respectively provided on both sides of the gas outlet pipe 6.

Specifically, the term "longitudinal" of the longitudinal baffle plate is not the same as the term "longitudinal" where the first chamber, the second chamber and the third chamber are arranged in a longitudinal direction. The term "longitudinal" where the chambers are arranged in a longitudinal direction refers to a longitudinal direction along the gas movement direction, i.e., the direction of gravity, while the term "longitudinal" of the longitudinal baffle plate means that the longitudinal baffle plate is vertical to the transverse baffle plates, or forms an angle along with the transverse baffle plates.

With the oil and gas separation device of the present embodiment, in the process of the three-stage oil and gas separation device, the oil and gas mixture enters the third chamber 12 through the second gas channel 11 and flows through the S-shaped labyrinth structure from the breather valve hole into the gas outlet pipe. The extremely few separated oil droplets thereof return to the second chamber 11 again through the oil return holes 15 provided on both sides of the first transverse baffle plate 16, and return to the internal combustion engine body 5 through the inclined wall of the cover for lubrication.

The gas passing through the S-shaped labyrinth structure will be sprayed when passing through the spraying hole formed by the second transverse baffle plate 17 and the longitudinal baffle plate 18. A part of the waste gas enters the gas outlet pipe 6, and a part of the waste gas is sprayed to the outside of the gas outlet pipe and flows into the S-shaped labyrinth structure through the gas backflow hole 19 for another circulation.

In this way, a movement path of the oil and gas mixture is lengthened again, so that a very small part of the engine oil contained in the oil and gas mixture in the third chamber 12 is completely separated from the waste gas, and returns to the internal combustion engine body through the oil return hole for lubrication. Therefore, only the waste gas without oil is discharged through the gas outlet pipe, having no loss of the engine oil.

The oil and gas separation device for the internal combustion engine of the present embodiment can completely separate the oil and gas mixture in the internal combustion engine body, and make the engine oil return to the internal combustion engine body for further usage, and the waste gas flows into an air filter through the gas outlet pipe for processing.

Moreover, the oil and gas separation device for the internal combustion engine of the embodiment has a good separation effect, and can ensure that no oil droplet flow out for 2500 hours at work, thereby avoiding loss of the engine oil. Thus, it is assured that the engine oil in the internal combustion engine is sufficient and the lubrication of various components in the internal combustion engine is good.

Further, the oil and gas separation device of the present embodiment can effectively separate the engine oil mixture even under severe working conditions such as high temperature, high pressure, and vibrations, and can still achieve the above-mentioned separation effect.

What is claimed is:

1. An oil and gas separation device for an internal combustion engine, comprising: a first chamber, a second chamber, and a third chamber provided successively from bottom to top, wherein the first chamber is connected to the second chamber through a first gas channel, the second chamber is connected to the third chamber through a second gas channel, the third chamber is connected to a gas outlet pipe, a bottom of the first chamber is a gas inlet, the bottom of the first chamber is provided with a lower oil baffle plate, and and the lower oil baffle plate comprises only a single central opening and a planer annulus with a sloped interior that surrounds the single central opening.

2. The oil and gas separation device for the internal combustion engine according to claim 1, wherein the lower oil baffle plate is arranged along the bottom of the first chamber, an outer edge of the lower oil baffle plate is connected to a housing of the oil and gas separation device, and the sloped interior of the lower oil baffle plate forms the gas inlet of the first chamber.

3. The oil and gas separation device for the internal combustion engine according to claim 2, wherein the lower oil baffle plate comprises an outer annulus, and the sloped interior defines an inner annulus, the outer annulus covers the first gas channel, and the inner annulus is toward an internal combustion engine body.

4. The oil and gas separation device for the internal combustion engine according to claim 2, wherein the first chamber, the second chamber, and the third chamber are successively arranged along the housing, the first chamber is composed of an inner wall of a cover and the lower oil baffle plate, the second chamber is composed of an outer wall of the cover, an upper oil baffle plate provided on the cover and an inner wall of the housing, and the third chamber is composed of the upper oil baffle plate and the inner wall of the housing.

5. The oil and gas separation device for the internal combustion engine according to claim 4, wherein a gap between an edge of the cover, the housing, and the lower oil baffle plate forms the first gas channel; and a breather valve hole of a breather valve device provided on the upper oil baffle plate is the second gas channel.

6. The oil and gas separation device for the internal combustion engine according to claim 5, wherein the cover is provided with a side wall, the side wall inclines outward from a top surface of the cover to the internal combustion engine body.

7. The oil and gas separation device for the internal combustion engine according to claim 6, wherein the breather valve hole of the breather valve device faces toward the top surface of the cover, and the top surface of the cover is provided with an inclined oil guiding groove facing toward the breather valve hole.

8. The oil and gas separation device for the internal combustion engine according to claim 4, wherein the cover is provided with a side wall, the side wall inclines outward from a top surface of the cover to the internal combustion engine body.

9. The oil and gas separation device for the internal combustion engine according to claim 3, wherein the first chamber, the second chamber, and the third chamber are successively arranged along the housing, the first chamber is composed of an inner wall of a cover and the lower oil baffle plate, the second chamber is composed of an outer wall of the cover, an upper oil baffle plate provided on the cover and an inner wall of the housing, and the third chamber is composed of the upper oil baffle plate and the inner wall of the housing.

10. The oil and gas separation device for the internal combustion engine according to claim 9, wherein a gap between an edge of the cover, the housing, and the lower oil baffle plate forms the first gas channel; and a breather valve hole of a breather valve device provided on the upper oil baffle plate is the second gas channel.

11. The oil and gas separation device for the internal combustion engine according to claim 10, wherein the cover is provided with a side wall, the side wall inclines outward from a top surface of the cover to the internal combustion engine body.

12. The oil and gas separation device for the internal combustion engine according to claim 11, wherein the breather valve hole of the breather valve device faces toward the top surface of the cover, and the top surface of the cover is provided with an inclined oil guiding groove facing toward the breather valve hole.

13. The oil and gas separation device for the internal combustion engine according to claim 9, wherein the cover is provided with a side wall, the side wall inclines outward from a top surface of the cover to the internal combustion engine body.

14. The oil and gas separation device for the internal combustion engine according to claim 1, wherein the first chamber, the second chamber, and the third chamber are successively arranged along the housing, the first chamber is composed of an inner wall of a cover and the lower oil baffle plate, the second chamber is composed of an outer wall of the cover, an upper oil baffle plate provided on the cover and an inner wall of the housing, and the third chamber is composed of the upper oil baffle plate and the inner wall of the housing.

15. The oil and gas separation device for the internal combustion engine according to claim 14, wherein a gap between an edge of the cover, the housing, and the lower oil baffle plate forms the first gas channel; and a breather valve hole of a breather valve device provided on the upper oil baffle plate is the second gas channel.

16. The oil and gas separation device for the internal combustion engine according to claim 14, wherein the cover is provided with a side wall, the side wall inclines outward from a top surface of the cover to the internal combustion engine body.

17. The oil and gas separation device for the internal combustion engine according to claim 16, wherein the breather valve hole of the breather valve device faces toward the top surface of the cover, and the top surface of the cover is provided with an inclined oil guiding groove facing toward the breather valve hole.

18. The oil and gas separation device for the internal combustion engine according to claim 14, wherein a labyrinth structure is provided inside the third chamber, and the labyrinth structure is composed of at least one limiting block transversely arranged between the breather valve hole and the gas outlet pipe.

19. The oil and gas separation device for the internal combustion engine according to claim 18, wherein the labyrinth structure comprises a first transverse baffle plate provided proximate the breather valve hole and a second transverse baffle plate provided proximate the gas outlet pipe, an end of the first transverse baffle plate and an end of the second transverse baffle plate are connected to a wall of the housing, the other ends thereof are spaced from the wall of the housing to form openings, the opening of the first transverse baffle plate and the opening of the second transverse baffle plate are arranged in opposite directions, and at least one side of the first transverse baffle plate is provided with an oil return hole connected to the second chamber.

20. The oil and gas separation device for the internal combustion engine according to claim 18, wherein the second transverse baffle plate is provided proximate the gas outlet pipe and faces toward the gas inlet of the gas outlet pipe, a longitudinal baffle plate is provided between the opening formed by the second transverse baffle plate and the wall of the housing and the gas inlet of the gas outlet pipe, a gas spraying hole is formed between the longitudinal baffle plate and the second transverse baffle plate, and a gas backflow hole is provided on the second transverse baffle plate on another side of the gas inlet of the gas outlet pipe.

* * * * *